US008192906B2

(12) United States Patent
Denton

(10) Patent No.: US 8,192,906 B2
(45) Date of Patent: Jun. 5, 2012

(54) BLACK TONER FORMULATION

(75) Inventor: Gary Allen Denton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 455 days.

(21) Appl. No.: 12/403,981

(22) Filed: Mar. 13, 2009

(65) Prior Publication Data

US 2010/0233606 A1 Sep. 16, 2010

(51) Int. Cl.
*G03G 9/09* (2006.01)

(52) U.S. Cl. ..... 430/107.1; 430/108.1; 430/108.9; 430/112; 430/115

(58) Field of Classification Search ..... 430/107.1, 430/108.1, 108.9, 112, 115
See application file for complete search history.

(56) References Cited

U.S. PATENT DOCUMENTS 4,424,292 A 1/1984 Ravinovitch et al.
5,028,507 A 7/1991 Kidnie
5,103,260 A 4/1992 Tompkins et al.
5,262,264 A 11/1993 Shimizu et al.
5,273,853 A 12/1993 Urano et al.
5,512,986 A 4/1996 Toyomura et al.
5,540,998 A 7/1996 Yamada et al.
6,009,285 A 12/1999 Barry et al.
6,120,959 A 9/2000 Sugizaki et al.
6,123,417 A 9/2000 Bard et al.
6,130,017 A 10/2000 Hayashi et al.
6,154,238 A 11/2000 Cook et al.
6,161,921 A 12/2000 Bard et al.
6,254,221 B1 7/2001 Bard et al.
6,521,038 B2 2/2003 Yanagimoto et al.
6,531,254 B1 3/2003 Bedells et al.
6,531,256 B1 3/2003 Bedells et al.
6,559,590 B1 5/2003 Mori et al.
6,560,418 B2 5/2003 Campbell et al.
6,628,398 B1 9/2003 Denton et al.
6,628,426 B2 9/2003 Denton et al.
6,731,889 B2 5/2004 Nakayama
6,797,218 B1 9/2004 Bickerstaff
6,913,864 B2 7/2005 Shimizu et al.
6,953,504 B2 10/2005 Nakata et al.
6,957,024 B2 10/2005 Shinkawa et al.
6,989,056 B2 1/2006 Babler
6,991,884 B2 1/2006 Sun et al.
7,006,250 B2 2/2006 Denton et al.
7,077,898 B2 7/2006 Babler
7,171,134 B2 1/2007 Denton et al.
2003/0017405 A1* 1/2003 Shimizu et al. ..... 430/108.1
2007/0020545 A1* 1/2007 Bossidan et al. ..... 430/108.21
2007/0196753 A1 8/2007 Carter Jr., et al.
2008/0070142 A1* 3/2008 Furuki et al. ..... 430/108.22
2008/0305422 A1* 12/2008 Shim et al. ..... 430/108.11
2009/0280425 A1* 11/2009 Denton et al. ..... 430/108.8

* cited by examiner

*Primary Examiner* — Hoa V Le

(57) ABSTRACT

A black toner formulation includes at least one non-black colorant selected from the group consisting of dyes, pigments, and combinations thereof. The black toner formulation has a total pigment loading of about 2 percent to less than or equal to about 9.5 percent by weight of total weight of the black toner formulation.

8 Claims, 7 Drawing Sheets

BLACK TONER FORMULATION

CROSS REFERENCES TO RELATED APPLICATIONS

Cross reference is made to application Ser. No. 11/871,245, entitled "BLACK TONERS CONTAINING INFRARED TRANSMISSIVE AND REFLECTING COLORANTS," filed Oct. 12, 2007 and application Ser. No. 12/118,239 entitled "BLACK TONER FORMULATIONS," filed May 9, 2008, both assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates to a black toner formulation for use in electrophotography for generating dark images, and more specifically, to a composite black toner formulation that has a low pigment loading, and is capable of exhibiting good darkness and hue, good fusing ability, and improved resistance to fade.

2. Description of the Related Art

Various types of toners have been used for generation of images on image-receiving media using a printing technique, such as electrophotography. Suitable examples of an image-receiving medium include, but are not limited to, paper, plastic, and textile. The technique of electrophotography is broadly used in photocopying machines, laser printers, Light-Emitting Diode (LED) printers, and the like. More specifically, the technique includes transfer of a specific toner to an image-receiving medium with the help of electrostatic charges. In other words, any printing system working on the principles of electrophotography employs an image-receiving medium, which during the course of a printing process gets imbued with variable areas of the electrostatic charges that correspond to an image to be printed. These variable areas of electrostatic charges are responsible to interact with the specific toner that subsequently may be fused and fixed on the image-receiving medium to generate a printed image thereon.

In general, a desirable quantity of a toner is required for printing images of a good quality on an image-receiving medium. Such a desirable quantity may be defined in terms of density, mass per unit area (M/A) of the toner, which is ideally characterized by a number of monolayers of the toner to collectively form a toner layer as applied on the image-receiving medium to form an image thereon. Therefore, controlling the quantity of the toner, and thereby ensuring consistent color reproducibility each time while printing requires a control over thickness of each toner monolayer as applied over the image-receiving medium. Consequently, toner patch sensors have been employed in electrophotography-based printing systems to control thickness of the toner layer applied over the image-receiving medium. The toner patch sensors are capable of monitoring the toner density of unfused images, thereby providing a means to control darkness of the printed images.

However, control of image darkness and the associated intensity of color of a toner, has always been challenging in electrophotography-based printing systems. More specifically, such a problem is prevalent for producing dark images using a black toner. In general, a conventional black toner used for generating black colored fixed or stable images employs a black colorant. A suitable example of the black colorant is carbon black.

However, carbon black has been identified and listed as a carcinogenic agent by governmental authorities of various countries. Accordingly, large-scale use of carbon black has been discouraged in many countries. Further, a conventional black toner that has a high carbon black loading strongly absorbs light in a wavelength of about 200 nanometers (nm) to about 2000 nm. Therefore, the conventional black toner may produce a relatively weak reflected infrared signal for a toner patch sensor that operates at a wavelength near 940 nm (hereinafter referred to as 'toner patch sensor wavelength'). More specifically, as the toner patch sensor emits and detects light at a wavelength ranging from about 750 nm to about 1000 nm, and more particularly, from about 900 nm to about 1000 nm, strong absorbance at the toner patch sensor wavelength acts to prevent most photons, emitted by the toner patch sensor, from interacting with toner particles that are present in a lower portion of the toner monolayer. This results in a degraded ability to determine and regulate thickness of the toner layer.

Consequently, black toner formulations with reduced carbon black levels have been developed. Such black toner formulations include different types of color pigments and dyes, and exhibit good darkness and hue along with good light fastness with reduced loading (such as 1.5 percent) of carbon black. By using significantly reduced carbon black loadings, toner powder reflectivity of such black toner formulations increases from about 2% to about 6%. Such an increase in toner powder reflectivity enables a toner patch sensor to detect the presence of black dots even on intermediate transfer belts with low reflectivity. A suitable example of such an intermediate transfer belt is one made of ethylene-tetrafluoroethylene copolymer (ETFE). Accordingly, an electrophotographic printer that employs such a black toner formulation is capable of accurately rendering black shade levels on an image-receiving medium. Further, detection of high toner powder reflectivity may prove useful for anti-counterfeiting and document authentication. Furthermore, the reduced carbon black loading has shown to significantly reduce a print defect associated with the transfer of the black toner formulation to an image-receiving medium in humid conditions.

However, such black toner formulations are more expensive to manufacture than conventional black toners due to the use of expensive color pigments, which are used as substitutes for carbon black for generating dark images. Further, the color pigments are required to be dispersed properly while preparing the black toner formulations, and accordingly, such a requirement significantly contributes to the processing cost of the black toner formulations. Furthermore, use of the black toner formulations that include a blend of color pigments poses fusing problems. Specifically, black toner formulations with reduced loading of carbon black require large quantities of the color pigments to be employed therein for adequate tinctorial strength. As used herein, the term "tinctorial strength" may refer to an optical absorbance per unit concentration or loading of a color pigment. Accordingly, a high total pigment loading (for example, total pigment loading of greater than about 9.5%) in a black toner formulation does not allow the black toner formulation to fuse as easily as a conventional black toner. Consequently, high fusing temperatures are required for allowing fusing of the black toner formulation. However, the use of the high fusing temperatures may result in reduction of effective lifetime of various fusing components of a printer, while increasing energy consumption of the printer.

Further, few black toner formulations that include a blend of dyes have also been developed. Suitable examples of such dyes include, but are not limited to, a blue anthraquinone dye and a black indanthrone dye compound. However, most of the dyes in such conventional black toner formulations have low fade resistance. Consequently, the black toner formulations are incapable of exhibiting good darkness and hue over a period of time.

Accordingly, there is a need for a black toner formulation that is characteristic of exhibiting good darkness and hue, good fusing ability, and improved resistance to fade.

SUMMARY OF THE DISCLOSURE

In view of the foregoing disadvantages inherent in the prior art, the general purpose of the present disclosure is to provide a black toner formulation that is capable of exhibiting good darkness and hue, good fusing ability, and improved resistance to fade, to include all the advantages of the prior art, and to overcome the drawbacks inherent therein.

The present disclosure provides a black toner formulation that includes at least one non-black colorant. The at least one non-black colorant is selected from the group consisting of dyes, pigments, and combinations thereof. The black toner formulation has a total pigment loading of about 2 percent to less than or equal to about 9.5 percent by weight of total weight of the black toner formulation.

Further, the black toner formulation is characteristic of exhibiting good darkness and hue, good fusing ability, and improved resistance to fade. Accordingly, the black toner formulation is capable of generating dark electrophotographic images with good printing qualities.

BRIEF DESCRIPTION OF THE DRAWINGS

The above-mentioned and other features and advantages of this disclosure, and the manner of attaining them, will become more apparent and the disclosure will be better understood by reference to the following description of embodiments of the disclosure taken in conjunction with the accompanying drawings, wherein.

DETAILED DESCRIPTION

Figure 1A:
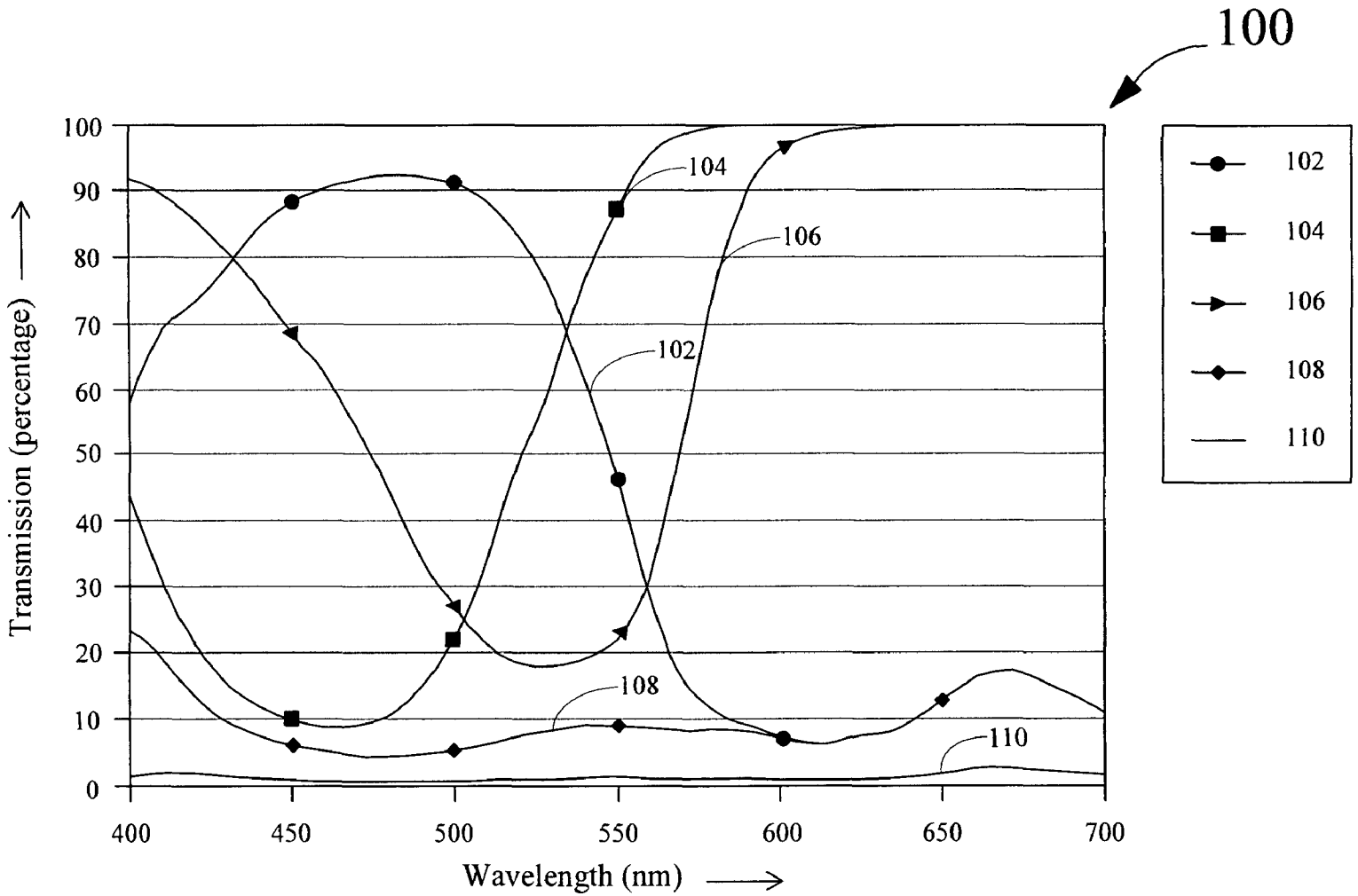
FIG. 1A depicts a graph for transmission spectra for a black toner formulation and components thereof, according to an embodiment of the present disclosure.

It is understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

As used herein, the term "loading" refers to a concentration of a colorant (either dyes, or pigments, or combinations thereof) that may be employed in a black toner formulation. Further, the term "total pigment loading" refers to total concentration of one or more pigments that may be employed in the black toner formulation. The concentration may be represented as "percentage" or "percent by weight". However, it should be apparent that the term may refer to a percent by weight value of a specific component of the black toner formulation with respect to the total weight of the black toner formulation.

As used herein, the term "CIE L*a*b*" refers to color space, "CIELAB", with coordinates L*, a*, and b*. CIELAB is the most complete color model for colors that are visible. The color model was recommended by International Commission on Illumination or Commission Internationale d'Eclairage (CIE) in 1976, as defined in JIS Z 8729 in the Japanese Industrial Standards (JIS). Coordinate L* represents a lightness index of a black toner formulation such that values of L* near zero indicate dark black and values of L* near 100 indicate white. Coordinate a* represents a position between red-to-magenta and green hue for a given color such that negative values of a* indicate green and positive values of a* indicate magenta. Coordinate be represents a position between yellow and blue hue for a given color such that negative values of be indicate blue and positive values of be indicate yellow.

As used herein, the term "hue" refers to an attribute of a color, in addition to lightness and chroma. More specifically, hue refers to pure spectrum colors or predominant colors that are commonly referred to by "color names" such as red, orange, yellow, blue, and green violet. Further, the term may represent dominant wavelength of any color.

The present disclosure provides a black toner formulation for use in electrophotography. The black toner formulation includes at least one non-black colorant (hereinafter referred to as "non-black" colorant). The non-black colorant is selected from the group consisting of dyes, pigments, and combinations thereof. The black toner formulation has a total pigment loading of about 2 percent to less than or equal to about 9.5 percent by weight of total weight of the black toner formulation. Specifically, the black toner formulation has a total pigment loading of about 2 percent to less than or equal to about 7 percent by weight of the total weight of the black toner formulation. Such a low pigment loading in the black toner formulation facilitates fusing of the black toner formulation while forming image on an image-receiving medium, such as paper and textile. Further, the black toner formulation of the present disclosure exhibits good darkness and hue, good fusing ability, and improved fade resistance. Accordingly, the black toner formulation is capable of generating images of good print quality.

The non-black colorant, as employed in the black toner formulation, is selected from the group consisting of a violet colorant, a yellow colorant, a cyan colorant, a blue colorant, a red colorant, an orange colorant, and combinations thereof. As described above, the non-black colorant is selected from the group consisting of dyes, pigments, and combinations thereof, accordingly, the term, "colorant," as used herein may be one of one or more dyes, one or more pigments, and combinations thereof. Further, selection of a specific dye, a specific pigment, and combinations thereof, may be based on the type of method, such as jet milling and emulsion aggregation, employed for preparing the black toner formulation.

In one embodiment of the present disclosure, the non-black colorant includes the cyan colorant, the red colorant, and the orange colorant. Specifically, the non-black colorant includes a cyan pigment, the red colorant, and the orange colorant. The cyan pigment employed in the black toner formulation is capable of exhibiting resistance to fade. Specifically, the cyan pigment is a good ultraviolet (UV) light absorber. A suitable example of the cyan pigment is phthalocyanine pigment blue, also referred to as Pigment Blue 15:3 or PB15:3.

The red colorant in the black toner formulation may include one or more red dyes and/or pigments. Similarly, the orange colorant in the black toner formulation may include one or more orange dyes and/or pigments. Further, the one or more orange dyes and the one or more red dyes, when used as the orange colorant and the red colorant, respectively, exhibit light fastness properties, and accordingly are fade resistant dyes. However, light fastness properties may be affected when such red and orange dyes are diluted with other components of the black toner formulation, as scattering of dye particles by particles of the components effectively increases UV exposure for an outermost layer of the black toner formulation, when used on an image-receiving medium. Accordingly, use of the cyan pigment, which is a good UV light absorber, helps reducing the fading of the red and the orange dyes.

Suitable examples of the red colorant include, but are not limited to, Pigment Red 264, Solvent Red 195, and Pigment Red 179. Pigments such as Pigment Red 179 may be employed in the black toner formulation when the black toner formulation is prepared by jet milling. Suitable examples of the orange colorant include, but are not limited to, Pigment Orange 71; Solvent Orange 60; and MACROLEX® Orange R Gran, which is a mixture of Solvent Orange 107 and Solvent Orange 47 dyes.

Alternatively, the non-black colorant may include the cyan pigment, and, at least one of the violet colorant, the yellow colorant, and the blue colorant. Suitable examples of the violet colorant include, but are not limited to, Pigment Violet 29 and Solvent Violet 13. Pigments such as Pigment Violet 29 may be employed in the black toner formulation when the black toner formulation is prepared by jet milling. A suitable example of the yellow colorant is Solvent Yellow 93. A suitable example of the blue colorant is Solvent Blue 35.

As described above in conjunction with various examples of the non-black colorant of the black toner formulation, the black toner formulation may include dyes that are solvent dyes with good light fastness. Further, the dyes that may be employed in the black toner formulation may be thermoplastic dyes, which may act as plasticizers for polymeric resins used to make the black toner formulation. Use of such dyes enables the black toner formulation to fuse easily, in order to improve crease test performance of the black toner formulation. The crease test performance of the black toner formulation may be assessed by printing an image on an image-receiving medium. Subsequently, the image-receiving medium may be subjected to cooling under ambient conditions prior to crease measurement. The image-receiving medium may then be loosely folded, and may be subjected to sufficient pressure. For example, a cylinder may slowly be rolled one or more times over the folded image-receiving medium. Subsequently, the image-receiving medium may be unfolded and the crease area may be thoroughly wiped to remove any unaffixed black toner formulation. Width along the crease from where the black toner formulation is removed may be measured using a ruler (such as a ruler calibrated in millimeters (mm)). Such a crease test performance helps in determining adhesion capabilities of the black toner formulation of the present disclosure.

Further, the black toner formulation may optionally include at least one black colorant at about 0.25% to less than or equal to about 2% by weight of the total weight of the black toner formulation. A black colorant of the at least one black colorant may be nigrosin (Solvent Black 5). Alternatively, the black colorant of the at least one black colorant may be carbon black, which exhibits a reddish hue and is used as a pigment. It would be evident to a person skilled in the art that the black toner formulation may include a combination of such black colorants. For example, the black toner formulation of the present disclosure may include nigrosin along with carbon black.

Use of about 0.25% to less than or equal to about 2% of carbon black with only 7% total pigment loading in the black toner formulation allows for generation of dark black images of good print quality. Carbon black imparts dark hue to the images and the low total pigment loading facilitates proper fusing of the black toner formulation on an image-receiving medium. Specifically, the black toner formulation of the present disclosure may include a reduced loading, and more specifically, about 0.25% to about 2% of the total weight of the black toner formulation, of carbon black. Use of the reduced loading of carbon black helps in imparting an intense black color to the black toner formulation. Further, the presence of reduced loadings of carbon black, which is capable of absorbing light in near infrared (IR) spectrum, to some extent enables the black toner formulation to remain responsive to a toner patch sensor that operates at a wavelength near 940 nm. In addition, carbon black is also a strong absorber of UV light. Accordingly, the use of carbon black in the black toner formulation of the present invention helps in reducing the rate at which other components, such as the dyes, of the black toner formulation may undergo fading.

The black toner formulation may include at least one of a polymeric dispersant, a binder, a wax, and combinations thereof. It should be evident to a person skilled in the art that the black toner formulation may employ wax when prepared by jet milling. However, the black toner formulation may employ the polymeric dispersant and/or the binder when produced by Chemically Prepared toner (CPT) processes, and especially by emulsion aggregation method. Accordingly, selection of a specific polymeric dispersant, a specific binder, a specific wax, and combinations thereof, may be based on the type of method employed for preparing the black toner formulation.

The polymeric dispersant that may be used in the black toner formulation is capable of dispersing or dissolving the non-black colorant and/or the black colorant to prepare the black toner formulation. Such a combination of the polymeric dispersant and the non-black colorant and/or the black colorant may be referred to as a polymeric dispersion. In general, the polymeric dispersant provides strong interaction ability with surfaces of particles of the black colorant. More specifically, the polymeric dispersant helps in controlling size and toner properties of the particles of the non-black colorant and/or the black colorant. Further, the non-black colorant and/or the black colorant may be provided with the polymeric dispersant in an appropriate ratio to form a stable black toner formulation. The polymeric dispersant as used herein may be a polymeric dispersant that is known in the art.

The binder that may be employed in the black toner formulation is capable of imparting fusing properties thereto. More specifically, the binder may be a polymeric resin. Further, a thermoplastic-type polymer may be used to prepare a suitable binder for use in the black toner formulation. Suitable examples of a polymer for use in the polymeric resin may include, but are not limited to, a polyester polymer, a styrene-acrylate polymer, an acrylic polymer, an epoxy polymer, a urethane polymer, and combinations thereof. A polystyrene-acrylate emulsion may also be used as the polymeric resin for preparing the black toner formulation of the present disclosure. The binder, as used herein, may be a binder that is known in the art.

The black toner formulation may include wax as a fusing release agent. Use of the wax helps in improving fixing ability of the black toner formulation when used for printing purposes. When employed with a binder for use in the black toner formulation, the wax may be uniformly distributed in the binder for improving compatibility of the black toner formulation. The wax, as used herein, may be a wax that is known in the art for use in black toner formulation. In one embodiment, the wax as used herein may have a melting point ranging from a temperature of about 50° C. to about 100° C.

In addition, the black toner formulation includes an additive selected from the group consisting of charge control agents ($TiO_2$), surfactants, emulsifiers, and combinations thereof. The charge control agents help in preventing deterioration of charge properties of the black toner formulation. The additive, as used herein, may include the charge control agents that are known in the art. Further, the black toner formulation may include silica (such as colloidal silica, sold under the tradename AEROSIL® A-380) for providing improved flowability to toner particles.

Various conventional methods may be employed to prepare different types of the black toner formulation of the present disclosure. As an illustrative example, a method for preparing a black toner formulation of the present disclosure includes melt mixing a resin with the blue pigment, the red colorant, and the orange colorant, and other components, to form a melt-mixed composition. The melt-mixed composition may be crushed, pulverized, jet milled, and classified to provide fine toner particles of a desired size. As an alternate illustrative exemplar, the method includes preparation of a CPT formulation. More specifically, the method includes a chemical process such as emulsion aggregation or suspension polymerization in order to produce toner particles that may be employed for preparing the black toner formulation. For the emulsion aggregation process, the aforementioned components, and more specifically, the dyes, of the black toner formulation may be dissolved in a mixture of a solvent and a binder (such as a polymeric resin) to produce an emulsion of tinted resin particles to be used for preparing the black toner formulation of the present disclosure.

The black toner formulation is further illustrated by the following non-limiting examples. However, a person ordinarily skilled in the art would recognize that, the specific examples are intended to illustrate, not limit, the scope of the present disclosure.

Example 1

A black toner formulation, hereinafter referred to as "black toner formulation I," was prepared by jet milling using 5 grams (g) of NE 2158N (high molecular weight polyester, available from Kao Corporation), 1562 g of NE 2141N (low molecular weight polyester, available from Kao Corporation), 644 g of Hostacopy BG C106 (40% PB15:3 in NE701 polyester resin from Kao Corporation), 100 g of MACROLEX® Red B dye (Solvent Red 195, obtained from Lanxess Corporation), 101 g of MACROLEX® Orange R Gran dye (obtained from Lanxess Corporation) which was pre-melted into 2339 g of NE2158 (polyester resin from Kao Corporation), 50 g of POLYWAX® 500, 75 g of N-602 (ester wax), 50 g of AEROSIL® A-380, and 75 g of DL-N24M (charge control agent). Accordingly, total weight of the black toner formulation I was about 5000 g.

Specifically, the black toner formulation I was prepared using about 5.15% of PB15:3, about 2% of MACROLEX® Orange R Gran dye, and about 2% of MACROLEX® Red B dye. More specifically, the black toner formulation I was prepared by melt mixing MAC ROLEX® Orange R Gran dye with thermoplastic resin, NE2158, in an extruder to form an orange polyester master batch. However, production of a master batch of MACROLEX® Red B dye was not required, as MACROLEX® Red B dye was melted at a temperature, which was lower than that required for melting of MACROLEX® Orange R Gran dye. Accordingly, it would be evident to a person skilled in the art that the black toner formulation I may be prepared by jet milling or by CPT emulsion aggregation process.

To predict hue and darkness for the black toner formulation (such as the black toner formulation I) of the present disclosure, a toner formulation model was developed. The toner formulation model was capable of predicting hue and darkness of the black toner formulation I with good accuracy. Specifically, data from transmission spectra of various pigments and dyes, which are sold commercially for coloring thermoplastics, were obtained and used in the toner formulation model to predict hue and darkness of fused toner layers on an image-receiving medium, such as paper.

FIG. 1A depicts a graph 100 depicting transmission spectra (percentage of transmission against wavelength of light) for the black toner formulation I and components thereof. Graph 100 represents the transmission spectra that are characterized by change in transmission (in terms of percentage) with a change in the wavelength of light.

Specifically, graph 100 represents a transmission spectrum 102 for PB15:3; a transmission spectrum 104 for MACROLEX® Orange R Gran dye; a transmission spectrum 106 for MACROLEX® Red B dye; a transmission spectrum 108 for a mixture of the aforementioned three non-black colorants; and a reflection spectrum 110 (depicted as percentage reflectance) for the black toner formulation I on an image-receiving medium. Reflection spectrum 110 of the black toner formulation I on the image-receiving medium shows that the black toner formulation I exhibits good darkness and good hue.

Figure 1B:
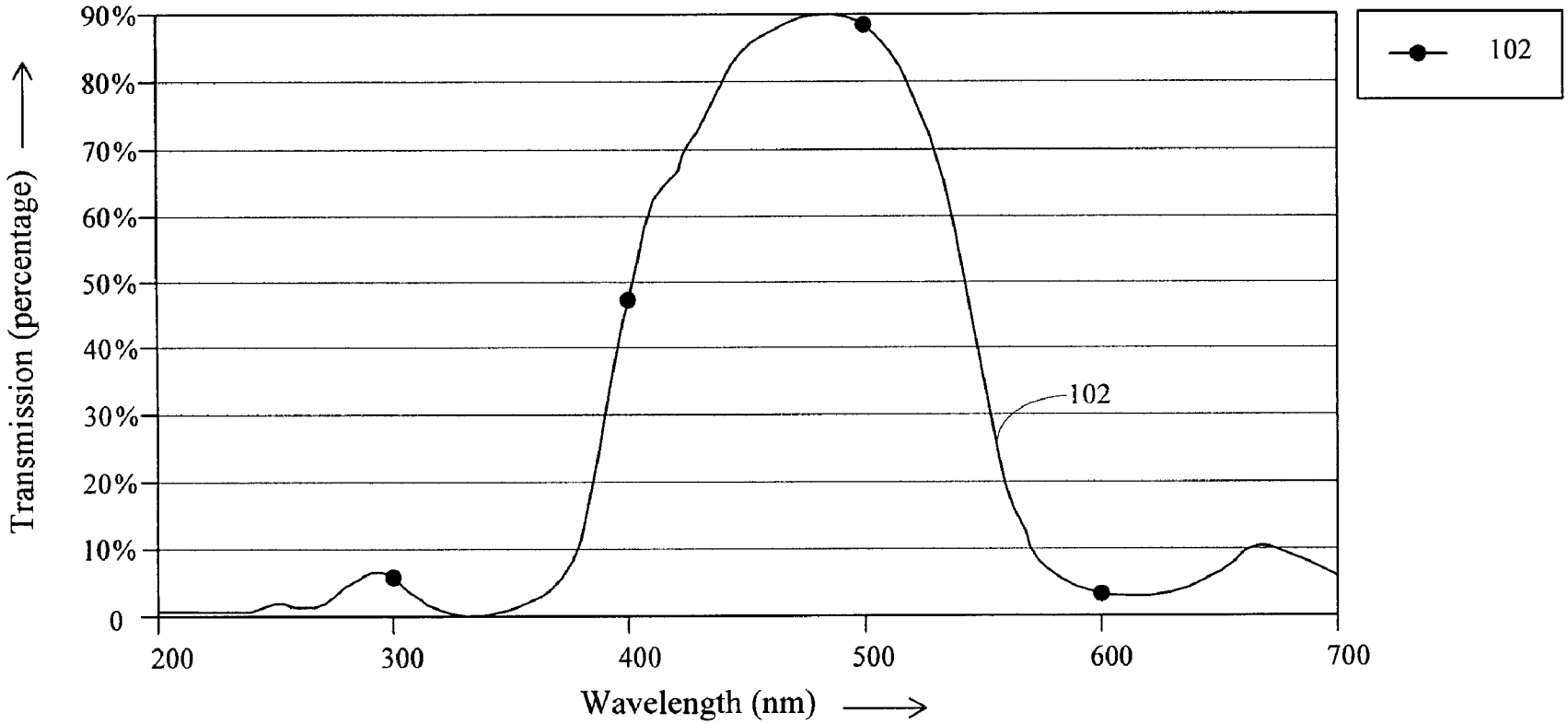
FIG. 1B depicts a graph for transmission spectrum for Pigment Blue 15:3 (PB15:3) employed in the black toner formulation of the present disclosure.

The transmission spectrum 102 is the transmission spectrum for light passing through about 1 centimeter (cm) of an aqueous dispersion of PB15:3. Specifically, the aqueous dispersion included about 0.00003 grams of PB15:3 per cubic centimeter ($cm^3$). It was observed that PB15:3 exhibits low transmission for light having wavelength below 380 nm, as depicted in FIG. 1B. Accordingly, PB15:3 is a relatively strong absorber in the UV radiation portion of the spectrum, where propensity of the light to cause chemical breakdown of dye and pigment molecules, in order to cause fading, is maximum. Accordingly, use of PB15:3 in the black toner formulation, such as the black toner formulation I, that may include dyes, allows for absorption of a significant portion of the UV radiation by PB15:3 particles. Consequently, PB15:3 produces a reduction in fading of the dyes employed in the black toner formulation of the present disclosure.

Figure 2:
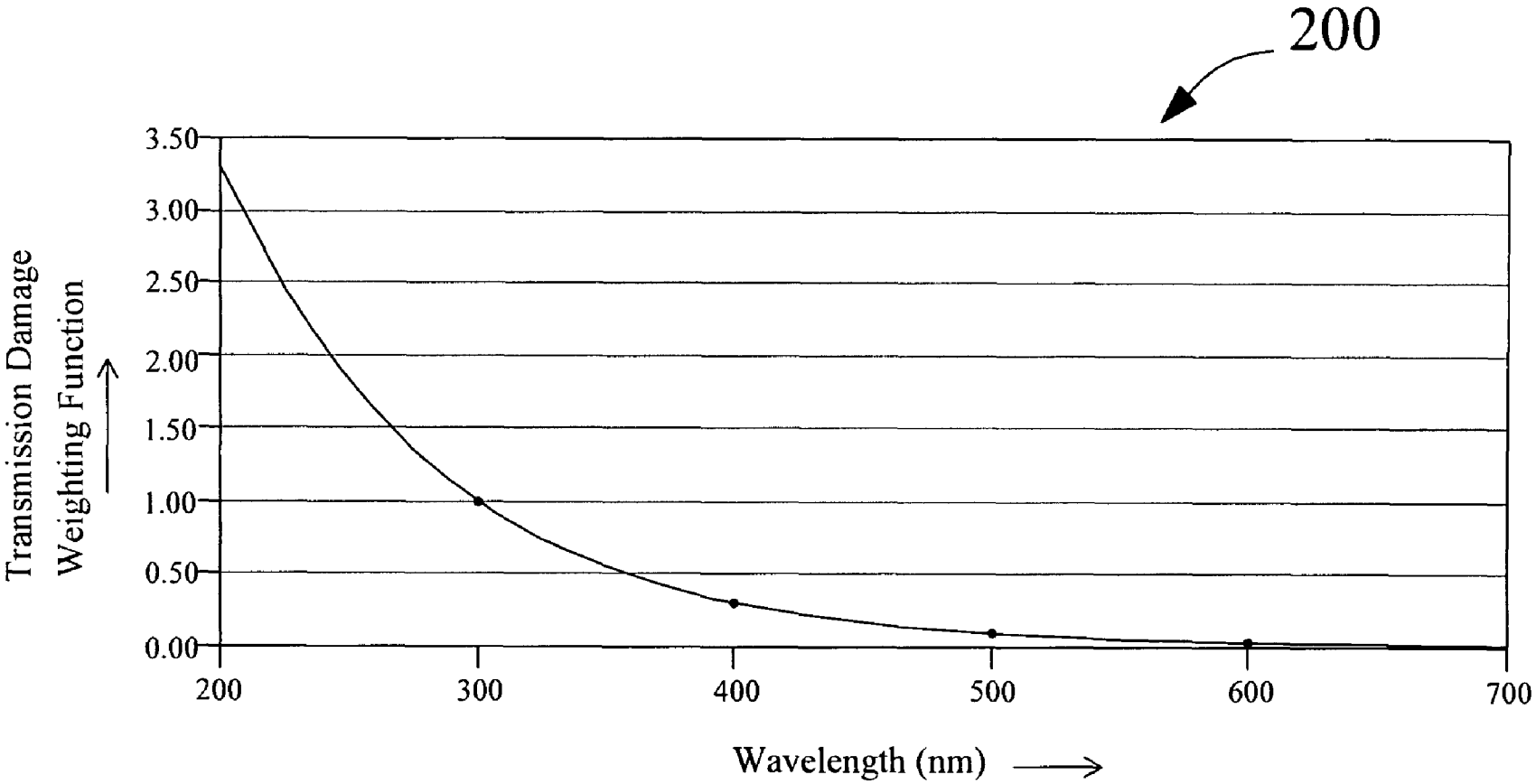
Figure 2 (PRIOR ART)
FIG. 2 depicts a prior art graph for illustrating an optical transmission damage-weighting function.

Calculations were performed combining data from transmission spectrum 102 for PB15:3 of FIGS. 1A and 1B, and an optical transmission damage-weighting function based on the work of Jurgen Krochmann, for determining effect of PB15:3 on fading of the dyes. The optical transmission damage-weighting function based on the work of Jurgen Krochmann will hereinafter be referred to as "Krochmann damage-weighting function". The Krochmann damage-weighting function was incorporated into ISO/CIE publication 89/3 as "On the deterioration of exhibited museum objects by optical radiation," and is referenced by National Fenestration Rating Council (NFRC) optical properties standard, NFRC 300, in computing damage-weighted transmittance, Tdw. The widely used Krochmann damage-weighting function for predicting fading has been depicted in FIG. 2. FIG. 2 depicts a graph 200, which is a prior art graph, for illustrating the Krochmann damage-weighting function. From FIG. 2, it may be observed that exposure to light having a wavelength below 400 nanometers (nm) significantly contributes to fading.

The Krochmann transmission damage-weighting function is defined by the following formula:

$$S(\lambda)=e^{3.6-12.0\lambda}$$

In the above formula, 'λ' is the wavelength of light in microns. The formula is commonly used to estimate damaging effects of light in computing Tdw, which measures the amount of fading-causing solar energy that contacts a surface, such as a fused toner layer, on an image-receiving medium. The lower the value of Tdw, the slower the rate of fading is expected for the black toner formulation, such as the black toner formulation I. It was further estimated that blocking the entire UV radiation portion of the solar spectrum would reduce the rate of any fading by a factor of about three. For example, any given toner layer on an image-receiving medium may fade by a certain amount in 3 years under normal solar exposure, however, the toner layer would take about 10 years to fade to the same extent when the effect of UV radiation is eliminated.

Based on the damage-weighting function and transmission spectrum 102 for PB15:3, the extent of reduction to fading of the dyes in a fused toner layer of the black toner formulation I of the present disclosure was estimated. The extent of reduction to fading of the dyes of the black toner formulation I due to absorption of light by the PB15:3 particles, was estimated using published values for intensity of solar radiation versus wavelength, the Krochmann damage-weighting function, and the transmission spectrum 102 of PB15:3. Accordingly, a fraction of the fading, depicted by 'X' in the formula given below, was estimated for the black toner formulation I having PB15:3.

$$X = \frac{\int_{200\ nm}^{700\ nm} S(\lambda)\times I(\lambda)\times T_{avg}(\lambda)\,d\lambda}{\int_{200\ nm}^{700\ nm} S(\lambda)\times I(\lambda)\,d\lambda}$$

As shown in the above formula, the fraction 'X' was calculated based on the damage-weighting function (S(λ)); the solar spectral intensity (I(λ)); and average transmission levels inside the toner layer ($T_{avg}(\lambda)$). $T_{avg}(\lambda)$ was calculated by subdividing the toner layer into 40 equal sub-layers, calculating the fraction of the incident light expected to reach a center portion of each sub-layer, and then calculating the average of the 40 fractional values.

Figure 3:
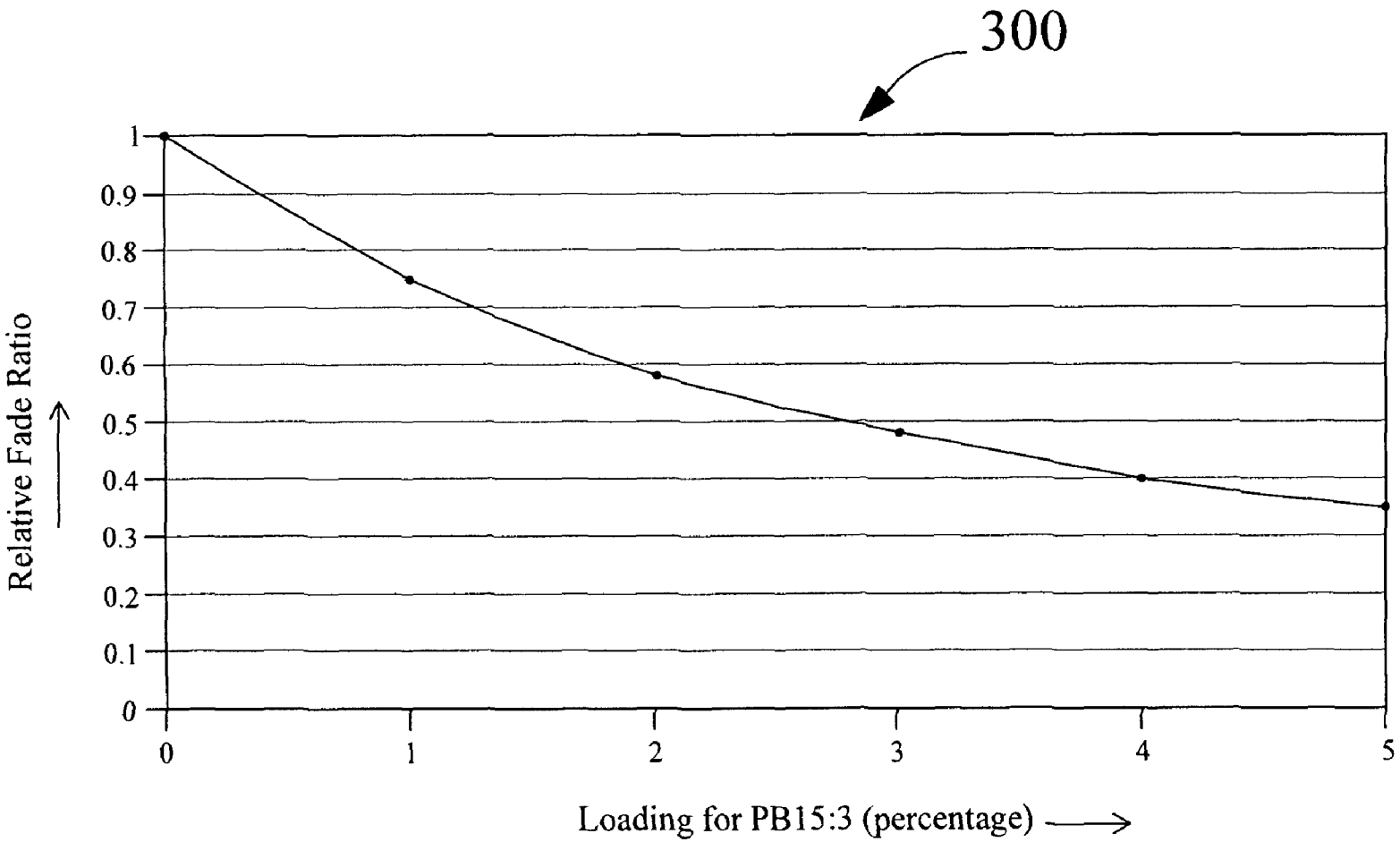
FIG. 3 depicts a graph for relative fade ratio for a range of PB15:3 loadings in the black toner formulation of the present disclosure.

FIG. 3 shows results of the calculations performed by combining the data from transmission spectrum 102 for PB15:3, and the Krochmann damage-weighting function. Specifically, FIG. 3 illustrates that fading of the dyes was reduced by the presence of PB15:3 in the black toner formulation of the present disclosure. More specifically, FIG. 3 depicts a graph 300 that illustrates relative fade ratio for a range of PB15:3 loadings in the black toner formulation. It was observed that there is no expected reduction in fade with 0% loading of PB15:3, and accordingly, the fade ratio is 1. Further, fading of the dyes was reduced by a factor of three when the black toner formulation included about 5% of PB15:3, and by a factor of two when the black toner formulation included about 3% of PB15:3. However, it was estimated that only half of dye molecules in the toner layer of the black toner formulation with about 3% loading of PB15:3 were expected to undergo damage by exposure to sunlight as opposed to a toner layer with 0% loading of PB15:3. At a 2% of PB15:3, the fading would be reduced about 40% as compared to a 0% loading of PB15:3.

Example 2

Figure 4:
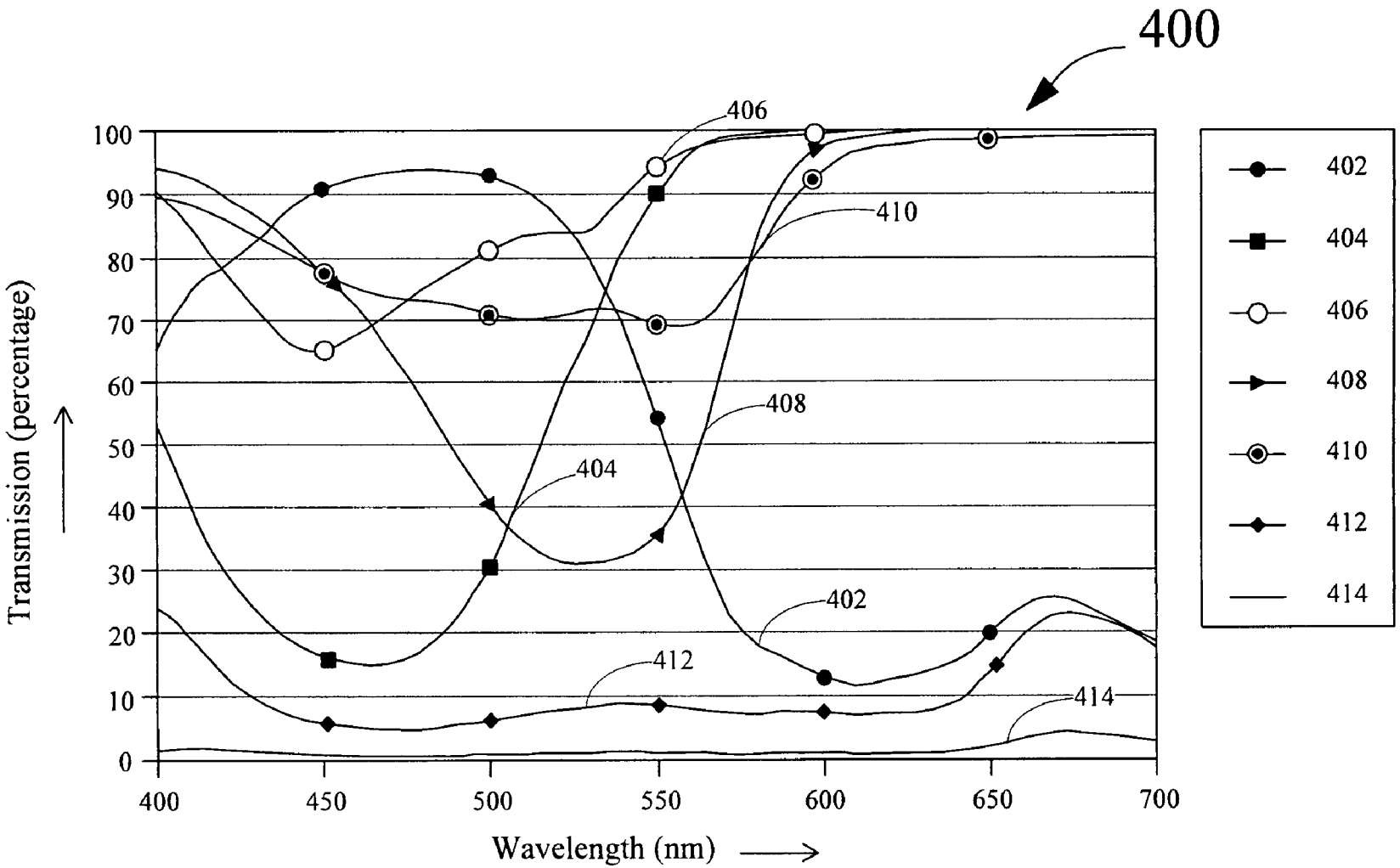
FIG. 4 depicts a graph for transmission spectra for a black toner formulation and components thereof, according to another embodiment of the present disclosure.

Another black toner formulation, hereinafter referred to as "black toner formulation II," of the present disclosure was investigated using the toner formulation model as described above. The black toner formulation II used about 4% of PB15:3; a combination of about 1% of Pigment Orange 71 and about 1.5% of MACROLEX® Orange R Gran dye for the orange colorant; and a combination of about 1% of Pigment Red 264 and about 1.17% of Solvent Red 195 dye for the red colorant. The toner formulation model, as described above in conjunction with black toner formulation I, was used to predict hue and darkness for the black toner formulation II. FIG. 4 shows predictions of the toner formulation model for the black toner formulation II in the form of transmission spectra for the black toner formulation II and components thereof. Specifically, a graph 400 represents a transmission spectrum 402 for PB15:3; a transmission spectrum 404 for MACROLEX® Orange R Gran dye; a transmission spectrum 406 for Pigment Orange 71; a transmission spectrum 408 for Solvent Red 195 dye; a transmission spectrum 410 for Pigment Red 264; a transmission spectrum 412 for a mixture of the aforementioned five non-black colorants; and a reflection spectrum 414 (depicted as percentage reflectance) for the black toner formulation II on an image-receiving medium. Reflection spectrum 414 of the black toner formulation II on the image-receiving medium shows that the black toner formulation II is expected to exhibit good darkness and good hue.

The black toner formulation II has a total pigment loading of about 6% and a total dye loading of about 2.67%, and accordingly, the black toner formulation II is expected to exhibit improved fade resistance over the black toner formulation I due to greater reliance of the black toner formulation II on fade resistant pigments.

Example 3

Figure 5:
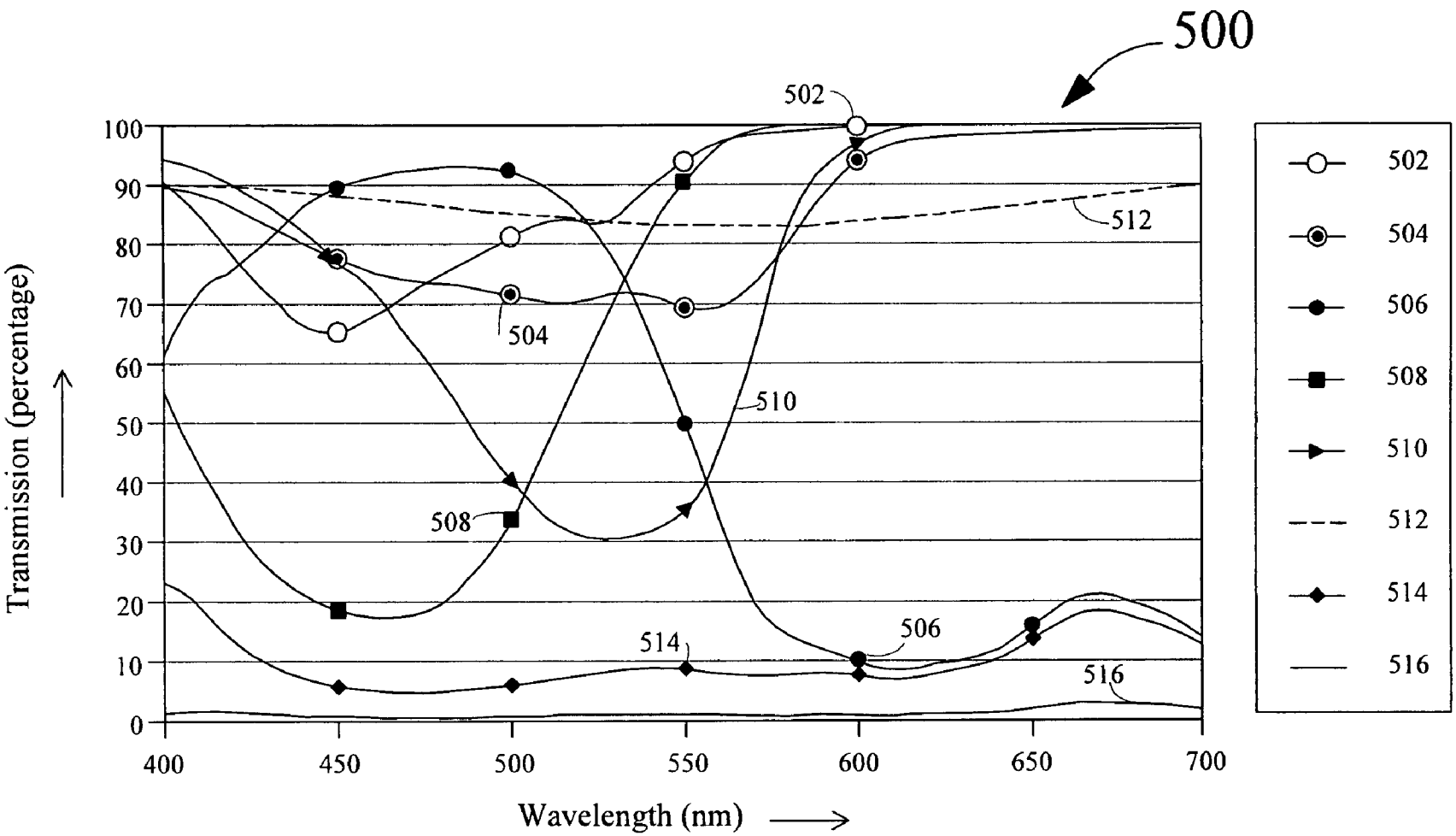
FIG. 5 depicts a graph for transmission spectra for a black toner formulation and components thereof, according to yet another embodiment of the present disclosure.

Another black toner formulation, hereinafter referred to as "black toner formulation III," was investigated using the toner formulation model described above. The black toner formulation III used about 4.56% of PB15:3; about 1% nigrosin; a combination of about 1% of Pigment Orange 71 and about 1.4% of MACROLEX® Orange R Gran dye for the orange colorant; and a combination of about 1% of Pigment Red 264 and about 1.18% of Solvent Red 195 dye for the red colorant. The toner formulation model was used again to predict hue and darkness for the black toner formulation III. FIG. 5 shows predictions of the toner formulation model for the black toner formulation III in the form of transmission spectra for the black toner formulation III and components thereof. Specifically, a graph 500 represents a transmission spectrum 502 for Pigment Orange 71; a transmission spectrum 504 for Pigment Red 264; a transmission spectrum 506 for PB15:3; a transmission spectrum 508 for MACROLEX® Orange R Gran dye; a transmission spectrum 510 for Solvent Red 195 dye; a transmission spectrum 512 for nigrosin; a transmission spectrum 514 for a mixture of the aforementioned six colorants; and a reflection spectrum 516 (depicted as percentage reflectance) for the black toner formulation III on an image-receiving medium. Reflection spectrum 516, as shown in graph 500, on the image-receiving medium shows that the black toner formulation III is predicted to exhibit good darkness and good hue.

Further, the black toner formulation III has a total pigment loading of about 6.56% and a total dye loading of about 3.58%, and accordingly, the black toner formulation III is expected to exhibit good fade resistance and to fuse easily than a black toner formulation with 9.5% of total pigment loading. The black toner formulation III is capable of absorbing a portion of toner patch sensor light at about 940 nm, as nigrosin has about half the absorption of carbon black at about 940 nm. Specifically, nigrosin is characteristic of exhibiting a low absorbance at a wavelength of about 900 nm. Accordingly, nigrosin may exhibit a weak to moderate absorbance at a wavelength of about 940 nm at which a toner patch sensor is capable of emitting and detecting light while monitoring density of a monolayer thereof. Such a property enables nigrosin to impart a moderate to low IR absorptivity or a good IR reflectivity to the black toner formulation III.

Black toner formulation III is predicted to exhibit a bulk powder reflectivity similar to that of a black toner formulation having 0.5% of carbon black, or about 30% reflectivity, at about 940 nm. Accordingly, black toner formulation III has a bulk powder reflectivity in the desirable range of about 10% to about 50%.

Example 4

Figure 6:
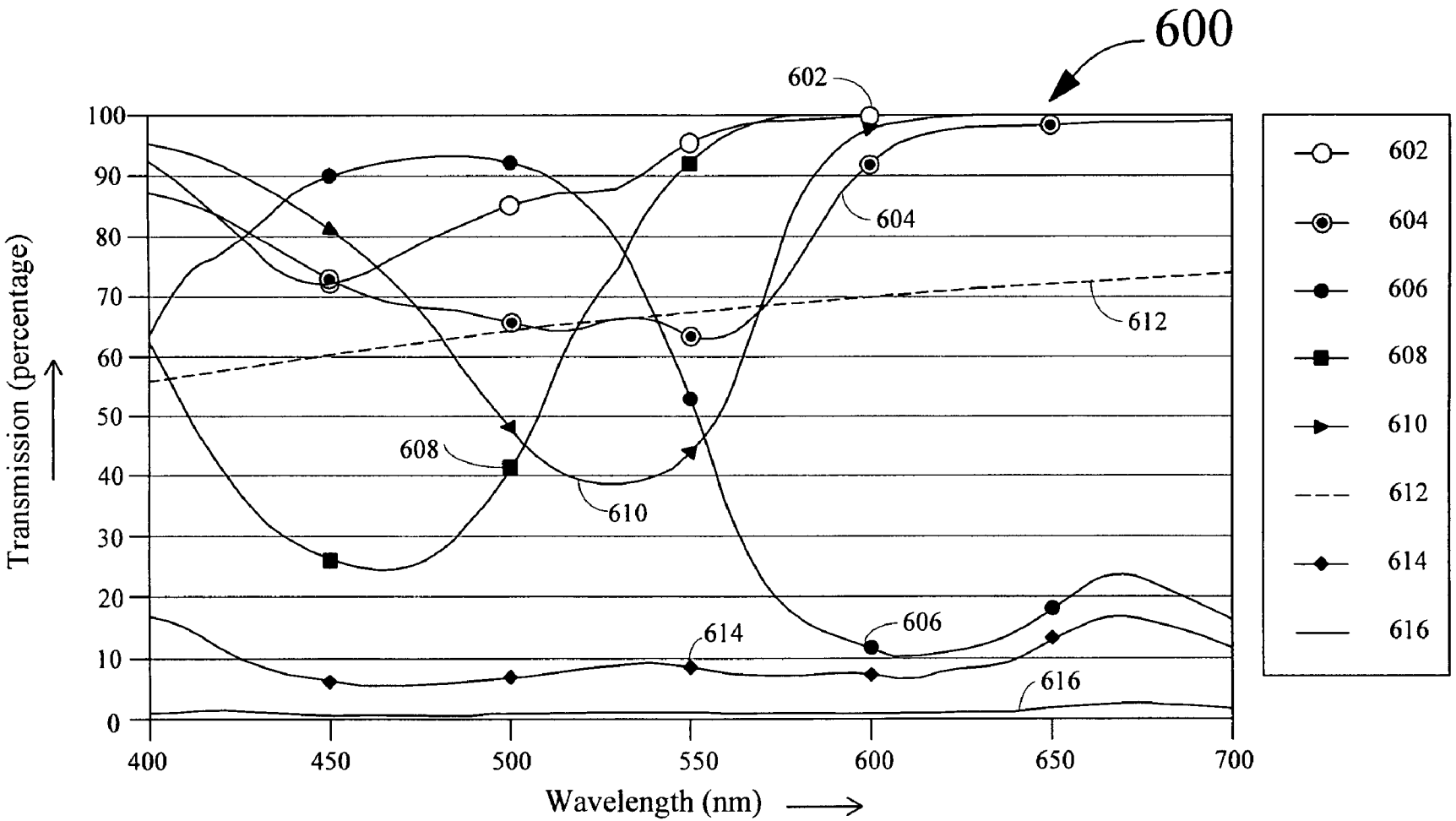
FIG. 6 depicts a graph for transmission spectra for a black toner formulation and components thereof, according to yet another embodiment of the present disclosure.

Another black toner formulation, hereinafter referred to as "black toner formulation IV," was investigated using the toner formulation model as described above. The black toner formulation used about 4.24% of PB15:3; about 0.75% of carbon black, such as NP90-III manufactured by Evonik Industries; a combination of about 0.77% of Pigment Orange 71 and about 1.12% of MACROLEX® Orange R Gran dye for the orange colorant; and a combination of about 1.24% of Pigment Red 264 and about 0.95% of Solvent Red 195 dye for the red colorant. The toner formulation model, as described above, was used to predict expected hue and darkness characteristics for the black toner formulation IV. FIG. 6 shows predictions of the toner formulation model for the black toner formulation IV in the form of transmission spectra for the black toner formulation IV and components thereof. Specifically, a graph 600 represents a transmission spectrum 602 for Pigment Orange 71; a transmission spectrum 604 for Pigment Red 264; a transmission spectrum 606 for PB15:3; a transmission spectrum 608 for MACROLEX® Orange R Gran dye; a transmission spectrum 610 for Solvent Red 195 dye; a transmission spectrum 612 for NP90-III; a transmission spectrum 614 for a mixture of the aforementioned six colorants; and a reflection spectrum 616 (depicted as percentage reflectance) for the black toner formulation IV on an image-receiving medium. Reflection spectrum 616 on the image-receiving medium spectra for the black toner formulation IV, as observed from graph 600, shows that the black toner formulation IV is predicted to exhibit good darkness and good hue.

Black toner formulation IV has a total pigment loading of about 7.0% and a total dye loading of about 2.31%. The reduced pigment loading should enable the black toner formulation IV to exhibit better fuse grade performance, as opposed to a black toner formulation having about 9% to about 9.5% of pigment loading. Further, use of a small percentage, such as 0.75%, of carbon black enables the black toner formulation IV to exhibit a bulk powder toner reflectivity of approximately 18%, at 940 nm. Such a bulk powder toner reflectivity is about 3 times the bulk powder toner reflectivity of the black toner formulation having about 9% to about 9.5% of the pigment loading, and is about 9 times the bulk powder toner reflectivity of a conventional black toner having a high concentration of carbon black.

By using a combination of pigments and dyes, as illustrated by the aforementioned examples, the above described black toner formulations of the present disclosure serve as composite black toners, which are prepared to have low pigment loadings, while exhibiting good fuse grade, and crease test performance. The black toner formulations further provide high bulk powder reflectivity, and accordingly, provide improved detectability by toner patch sensors operating in near infrared region. For example, a black toner formulation of the present disclosure that includes the cyan pigment (PB 15:3), an orange dye, and a red dye without carbon black is capable of providing a high reflectivity. Such a black toner formulation may be prepared by jet milling. Alternatively, a black toner formulation of the present disclosure that includes three or more pigments and two or more dyes, and exhibits high IR reflectivity may also be prepared while having low total pigment loading. In another example, a black toner formulation of the present disclosure may be prepared in order to have moderate IR reflectivity while having a low total pigment loading in order to facilitate fusing. It should be evident that other combinations of pigments and dyes may be used in order to provide sufficient quantities of the non-black colorant, for preparing the black toner formulation of the present disclosure with acceptable fuse grade and light fastness.

The present disclosure provides an effective black toner formulation that includes at least one non-black colorant. Specifically, the black toner formulation of the present disclosure includes a combination of dyes and/or pigments. More specifically, the black toner formulation includes a cyan pigment (fade resistant pigment), along with other dyes and/or pigments. The use of cyan pigment in combination with other pigments and/or dyes allows for reducing fading of the dyes, and of the black toner formulation when used for printing on an image-receiving medium. Further, the black toner formulation is prepared to have a low pigment loading, while exhibiting good fuse grade, light fastness, and crease test performance. Furthermore, the black toner formulation provides high IR reflectivity. Accordingly, the black toner formulation is capable of reliably generating intense dark images that exhibit resistance to fading. In addition, it should be obvious to persons skilled in the art that the efficiency of the black toner formulation of the present disclosure depends on the composition thereof, concentrations of various components thereof, and chemistry or compatibility among the various components.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A black toner formulation comprising:

a cyan pigment;

a red dye; and an orange dye;

wherein the black toner formulation has a total pigment loading of about 2 percent to less than or equal to about 9.5 percent by weight of total weight of the black toner formulation and the black toner formulation is substantially free of black colorants.

2. The black toner formulation of claim 1 further comprising a red pigment, and one an orange pigment.

3. The black toner formulation of claim 1 wherein the cyan pigment is phthalocyanine pigment blue.

4. The black toner formulation of claim 1 further comprising at least one of a polymeric dispersant, a binder, a wax, and combinations thereof.

5. The black toner formulation of claim 1 further comprising an additive selected from the group consisting of charge control agents, surfactants, emulsifiers, and combinations thereof.

6. The black toner formulation of claim 1 wherein the total pigment loading of the black toner formulation is about 2 percent to less than or equal to about 7 percent by weight of the total weight of the black toner formulation.

7. The black toner formulation of claim 1 wherein the cyan pigment is present at about 5.15% by weight of the total weight of the black toner formulation, the orange dye is present at about 2% by weight of the total weight of the black toner formulation, and the red dye is present at about 2% by weight of the total weight of the black toner formulation.

8. The black toner formulation of claim 3 wherein the cyan pigment is present at about 4% by weight of the total weight of the black toner formulation, the orange pigment is present at about 1% by weight of the total weight of the black toner formulation, the orange dye is present at about 1.5% by weight of the total weight of the black toner formulation, the red pigment is present at about 1% by weight of the total weight of the black toner formulation, and the red dye is present at about 1.17% by weight of the total weight of the black toner formulation.

* * * * *